US009010601B2

(12) United States Patent
Chen

(10) Patent No.: US 9,010,601 B2
(45) Date of Patent: Apr. 21, 2015

(54) TAPE DISPENSER

(71) Applicant: Chen-Hsiung Chen, Taichung (TW)

(72) Inventor: Chen-Hsiung Chen, Taichung (TW)

( * ) Notice: Subject to any disclaimer, the term of this patent is extended or adjusted under 35 U.S.C. 154(b) by 220 days.

(21) Appl. No.: 13/845,086

(22) Filed: Mar. 18, 2013

(65) Prior Publication Data

US 2014/0263525 A1 Sep. 18, 2014

(51) Int. Cl.

| | |
|---|---|
| ***B26F 3/00*** | (2006.01) |
| ***B65H 7/18*** | (2006.01) |
| ***B65H 35/00*** | (2006.01) |

(52) U.S. Cl.

CPC ..... *B65H 35/008* (2013.01); *B65H 35/0026* (2013.01); *B65H 35/0073* (2013.01)

(58) Field of Classification Search

USPC ..... 225/17, 6, 39–42, 77, 19, 29, 30, 33, 225/44–47, 55, 92; 242/598.5, 591, 588, 242/588.3, 588.6, 599.3, 598.3, 598, 599, 242/597, 597.2, 597.5, 597.7, 597.8

See application file for complete search history.

(56) References Cited

U.S. PATENT DOCUMENTS

| | | | | |
|---|---|---|---|---|
| 5,228,612 | A * | 7/1993 | Kuo et al. | 225/47 |
| 6,311,923 | B1 * | 11/2001 | Tsai | 242/598.5 |
| 6,371,403 | B1 * | 4/2002 | Shen | 242/598.2 |
| 6,988,690 | B2 * | 1/2006 | Hsu | 242/588.6 |
| 7,347,396 | B1 * | 3/2008 | Yu Chen | 242/599.3 |
| 7,392,962 | B2 * | 7/2008 | Hsiu-Man | 242/588.6 |
| 7,537,036 | B2 * | 5/2009 | Namekawa et al. | 156/463 |
| 2002/0185511 | A1 * | 12/2002 | Huang | 225/47 |
| 2003/0141337 | A1 * | 7/2003 | Yu Chen | 225/89 |

* cited by examiner

*Primary Examiner* — Phong Nguyen

(57) ABSTRACT

A tape dispenser includes a hollow body and a blade unit. The body has a frame, a blade seat and an opening. A reception portion is formed between the body and the frame so as to accommodate the tape. The opening communicates with inside of the body and the blade unit is located in the blade seat. The blade unit has a blade for cutting the tape.

20 Claims, 26 Drawing Sheets

TAPE DISPENSER

FIELD OF THE INVENTION

The present invention relates to a tape dispenser, and more particularly, to a tape dispenser with a simple structure and lower manufacturing cost.

BACKGROUND OF THE INVENTION

A conventional tape dispenser is disclosed in U.S. Pat. No. 6,311,923 and Taiwan Publication No. 439788 shown and generally includes a base, a frame and multiple suction members wherein the base has a recess for receiving a shaft therein so that the tape is mounted to the shaft. A blade is connected to the base. The base is a hollow base and a reception space is defined therein which opens to the top of the base so as to accommodate stationery accessories. A first connection portion is formed on the top of the base and has holes defined therethrough. The frame has a second connection portion which is connected to the first connection portion of the base. Each suction member has an engaging portion on the top thereof so as to be engaged with the holes in the base to position the suction members to the base to suck the frame. The frame is a hollow part which may be moved when the user pulls the tape. In order to improve the problem, weight such as sands or concrete is filled in the frame. The base, the frame and the shaft are made by plastic so that at least three sets of molds are required. The plastic shrinks during the molding processes, so that the there are tolerances between the connection faces between the parts and this can causes defectives to the products, especially for the parts with curved connection faces. The frame has two paths for accommodating the shaft and the paths are designed not to be straight to prevent the shaft from slip away, so that the molds have higher cost.

The present invention intends to provide a tape dispenser which has simple structure which is easily manufactured at lower cost.

SUMMARY OF THE INVENTION

The present invention relates to a tape dispenser and comprises a hollow body and a blade unit. The body has a frame, a blade seat and an opening. A reception portion is formed between the body and the frame so as to accommodate the tape. The opening communicates with inside of the body and the blade unit is located in the blade seat. The blade unit has a blade for cutting the tape.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
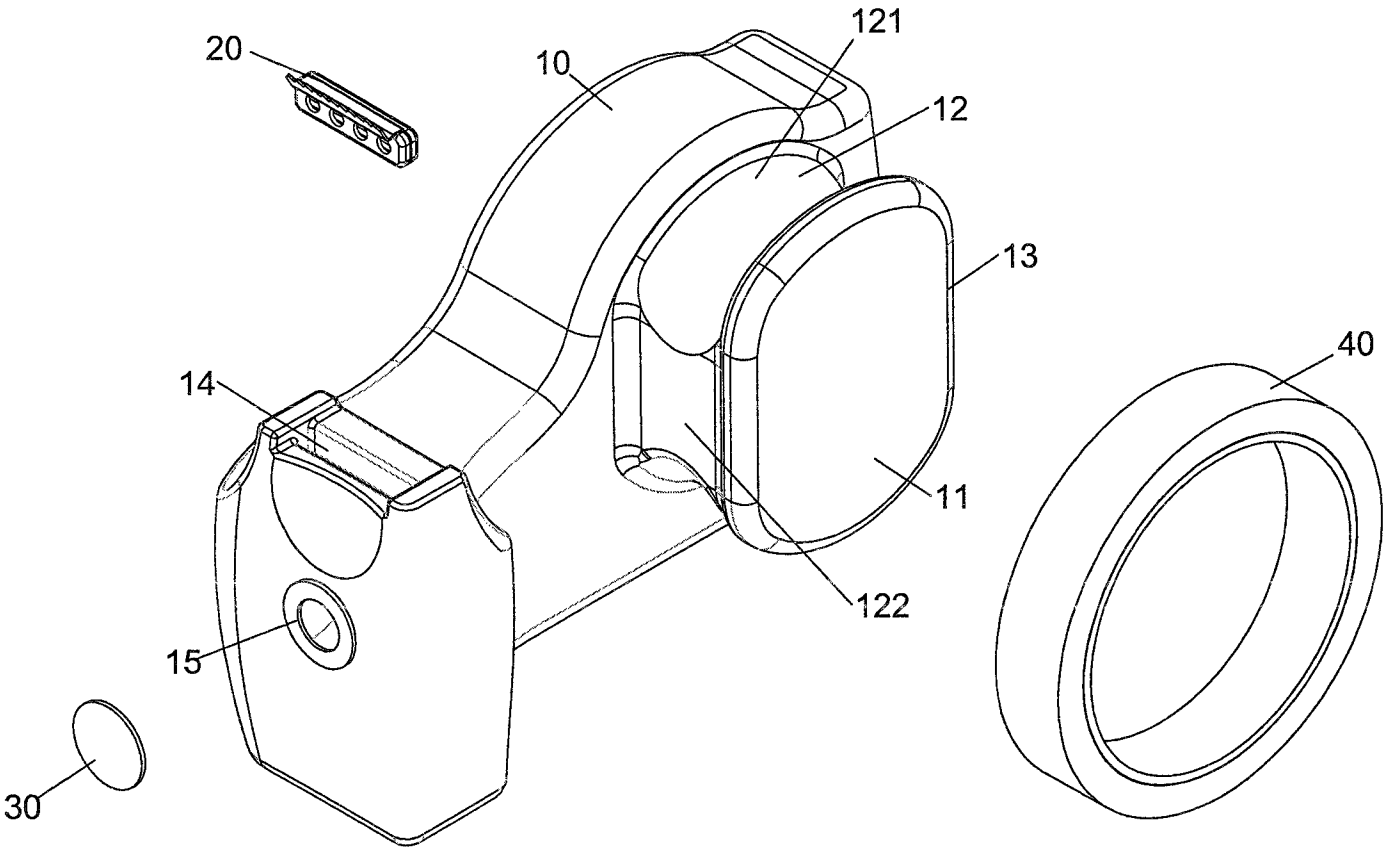
FIG. 1 is an exploded view to show the tape dispenser of the present invention.

Referring to FIG. 1, the tape dispenser of the present invention comprises a hollow body 10, a blade unit 20 and a seal member 30.

The body 10 is made by plastic ceramic or glass and has a frame 11 extending from one side thereof. A reception portion 12 is defined between the body 10 and the frame 11, and a tape 40 is put in the reception portion 12 which has two recesses 121 and two vertical portions 122. The two recesses 121 and the two vertical portions 122 are located alternatively to each other. The two vertical portions 122 are located at the front end and the rear end of the body 10. The frame 11 has a restriction portion 13 on the rear end thereof. A recessed blade seat 14 is defined in the front end of the body 10 and is located in opposite to the reception portion 12 along the axial direction of the body 10. The body 10 has an opening 15 which communicates with inside of the body 10, weight such as sands and concrete is located in the opening 15. The blade unit 20 is located in the blade seat 14 and has a blade 21 to cut the tape 40. A seal member 30 seals the opening 15 to prevent leakage of the weight from the opening 15.

Figure 3:
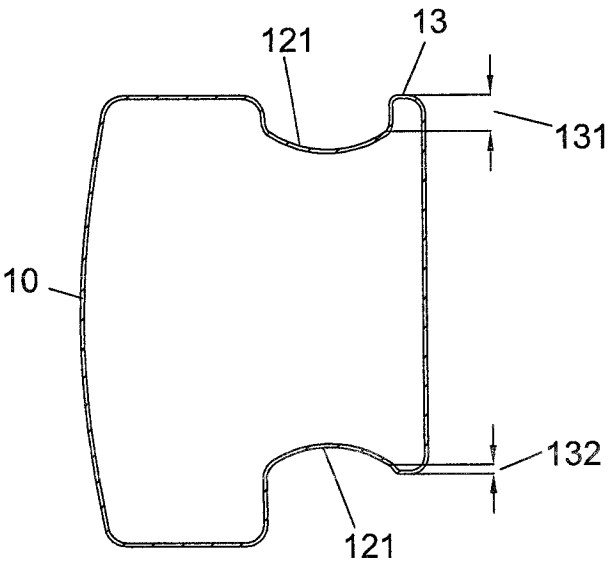
FIG. 3 is a cross sectional view, taken along line A-A in FIG. 2.
Figure 2:
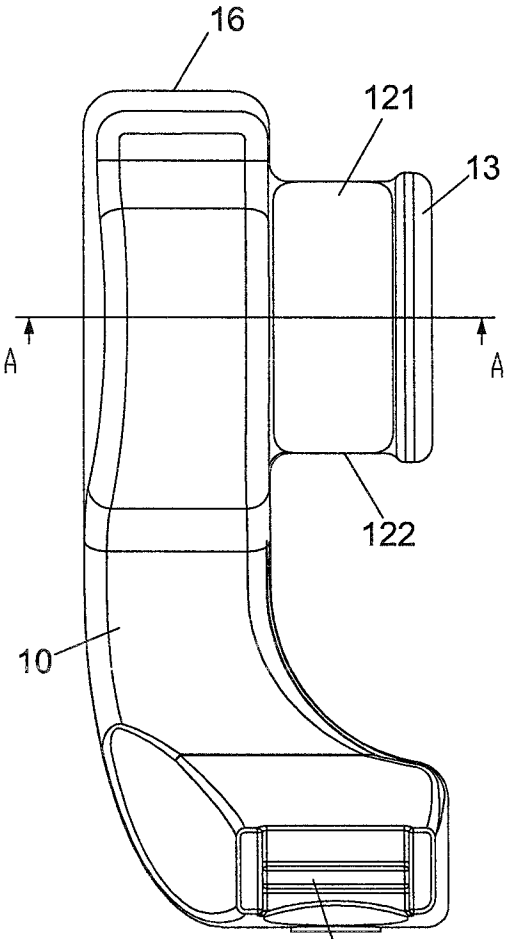
FIG. 2 is a top view of the tape dispenser of the present invention.

As shown in FIGS. 2 and 3, each recess 121 has a curved face so that when the tap 40 is located in the reception portion 12, it is smoothly rotated and located corresponding to the blade unit 20. The restriction portion 13 is located at the rear end of the frame 11 and has a first protrusion 131 and a second protrusion 132 respectively extending from the top end and the bottom end of the restriction portion 13. The first protrusion 131 is higher than the second protrusion 132 so that the tape 40 is well positioned. A stop 16 is formed on the rear end of the body 10 to allow the tape dispenser to stand upright.

Figure 4:
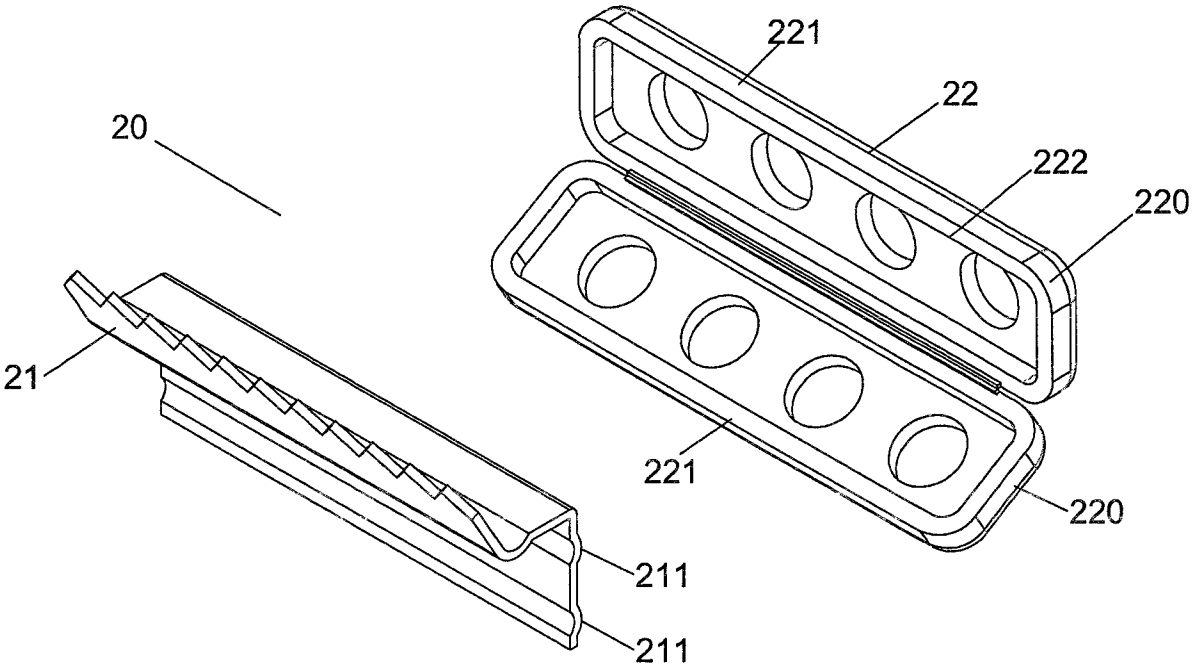
FIG. 4 is an exploded view to show the blade unit of the tape dispenser of the present invention.
Figure 5:
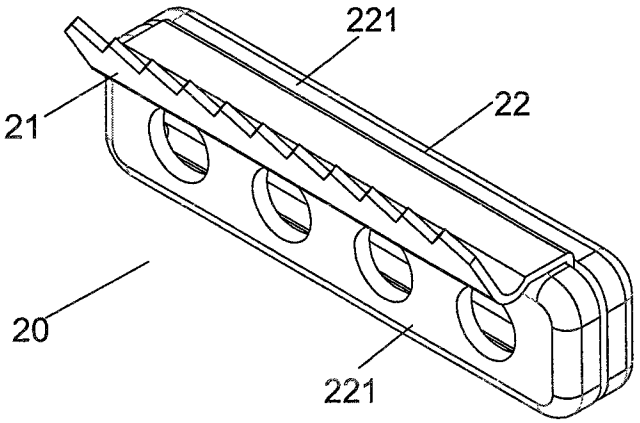
FIG. 5 is a perspective view to show the blade unit of the tape dispenser of the present invention.
Figure 6:
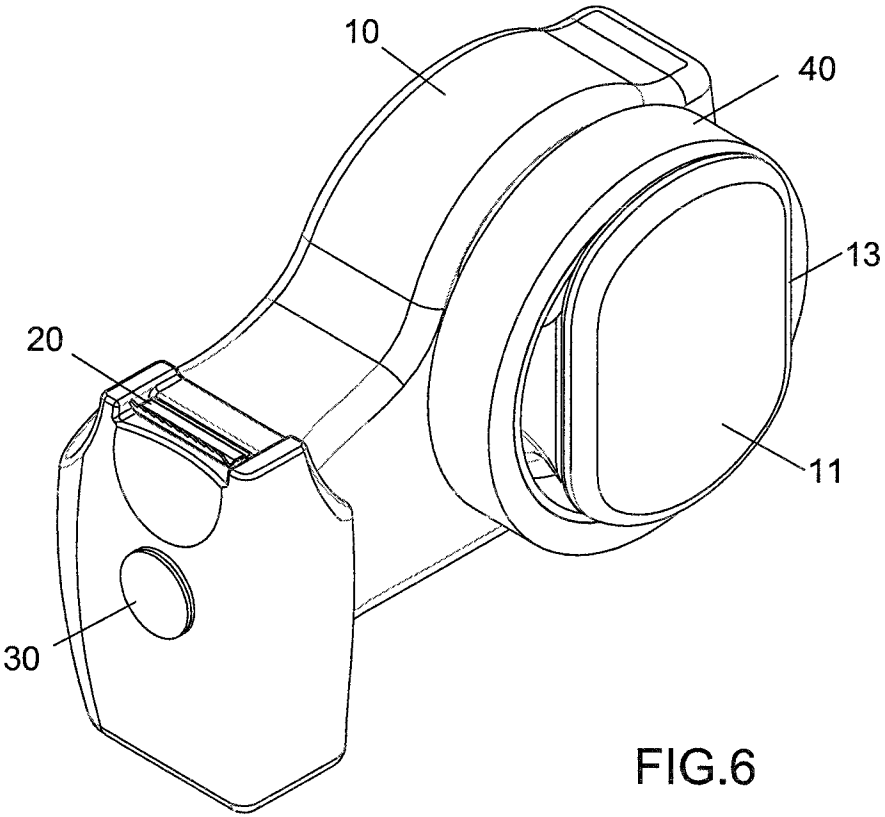
FIG. 6 is a perspective view to show the tape dispenser of the present invention.
Figure 9:
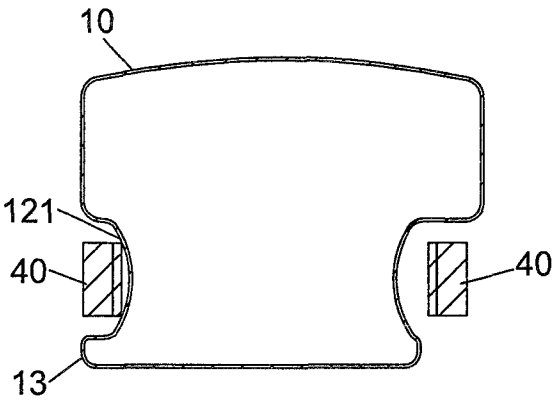
FIG. 9 is a cross sectional view, taken along line C-C in FIG. 7.
Figure 7:
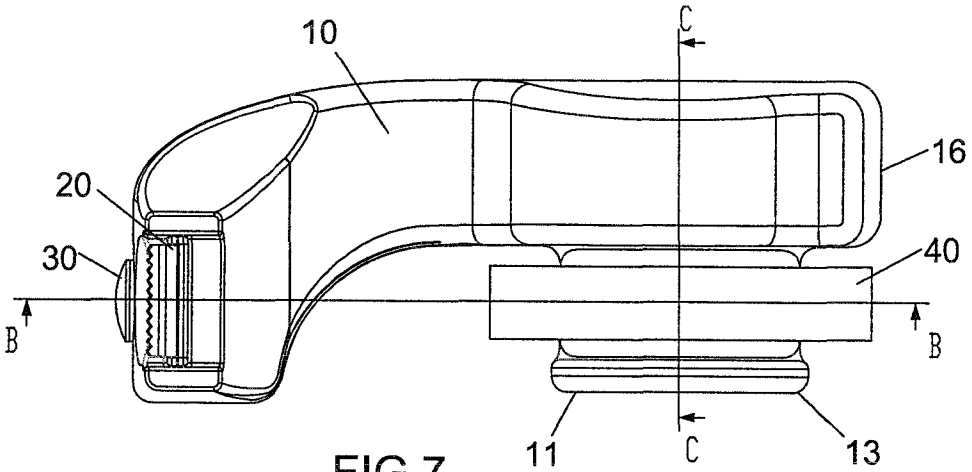
FIG. 7 is a top view of the tape dispenser of the present invention.
Figure 8:
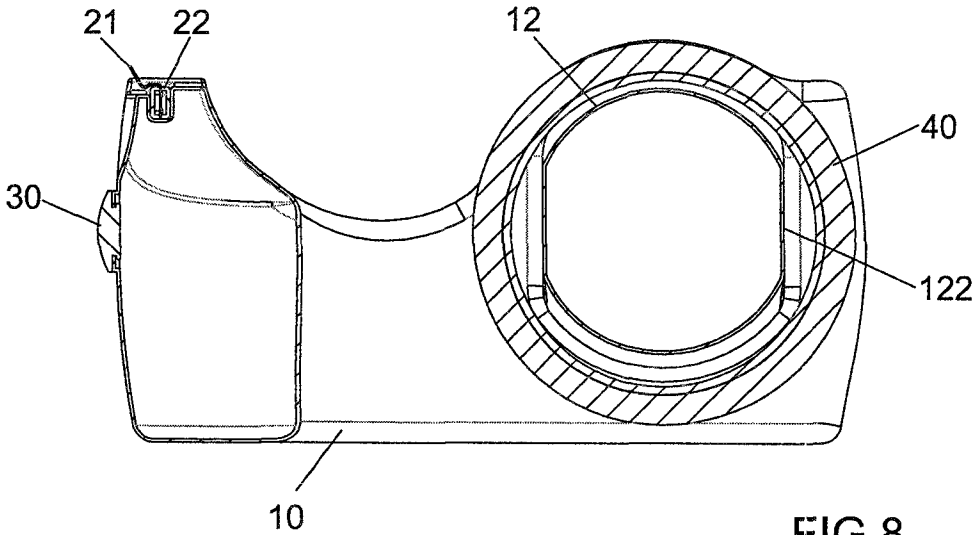
FIG. 8 is a cross sectional view, taken along line B-B in FIG. 7.

As shown in FIGS. 4 and 5, the blade unit 20 has a blade 21 and a blade carrier 22. The blade 21 has a flange 211 and is shaped as an inverted N. The blade carrier 22 has two connected plastic parts and each part has an edge 221 with a recessed area 222 defined therein. The two parts are connected to each other to clamp the blade 21. The flange 211 is engaged with the recessed areas 222, and the edge 221 restricts the flange 211 so that the blade 21 is connected to the blade carrier 22. The blade carrier 22 is engaged with the blade seat 14.

As shown in FIGS. 6 to 9, the blade carrier 22 is engaged with the blade seat 14, the seal member 30 seals the opening 15. The tape 40 is mounted to the reception portion 12 and located corresponding to the blade unit 20.

Figure 11:
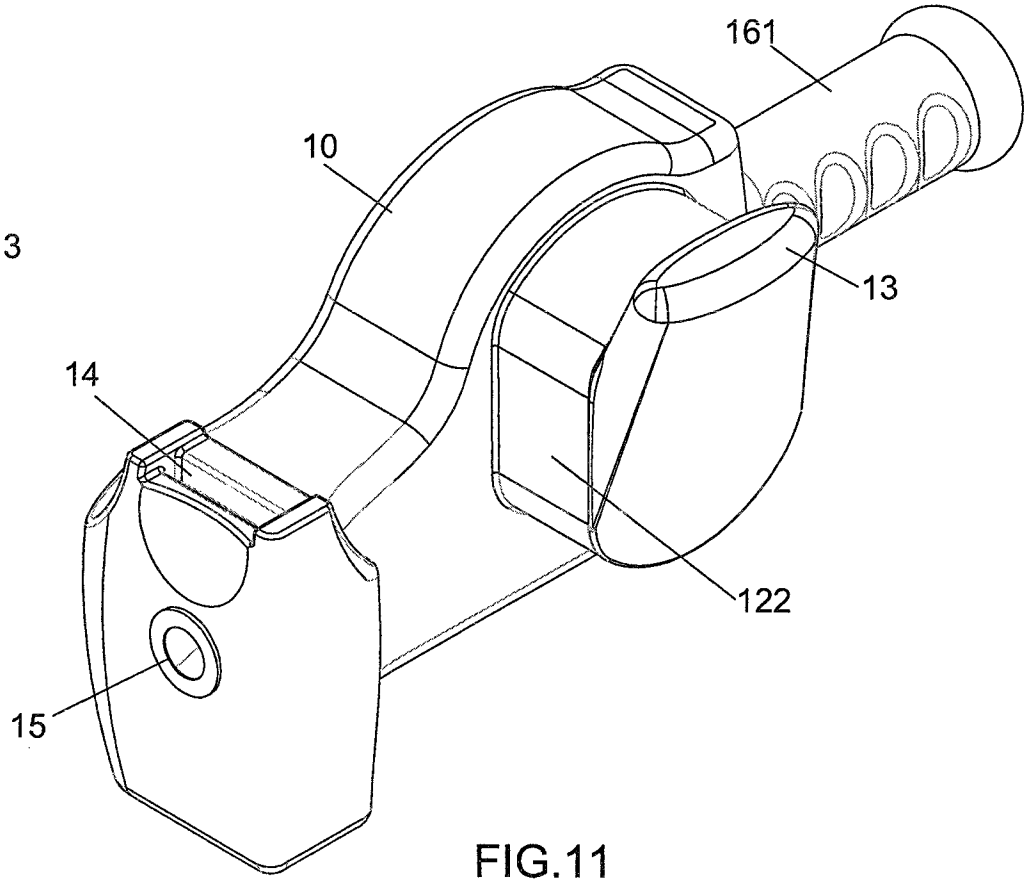
FIG. 11 is a side view to show the blade of the second embodiment of the tape dispenser of the present invention.
Figure 10:
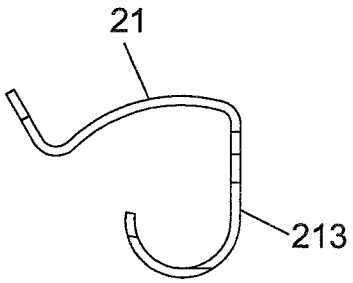
FIG. 10 is a perspective view to show the second embodiment of the tape dispenser of the present invention.

As shown in FIGS. 10 and 11, the restriction portion 13 faces upward, downward or rearward, and has only the first protrusion 131. The rear end of the contact end 16 has the handle 161 extending therefrom. The blade 21 is a U-shaped blade and has an elastic pressing portion 213 which is engaged with the blade seat 14.

Figure 12:
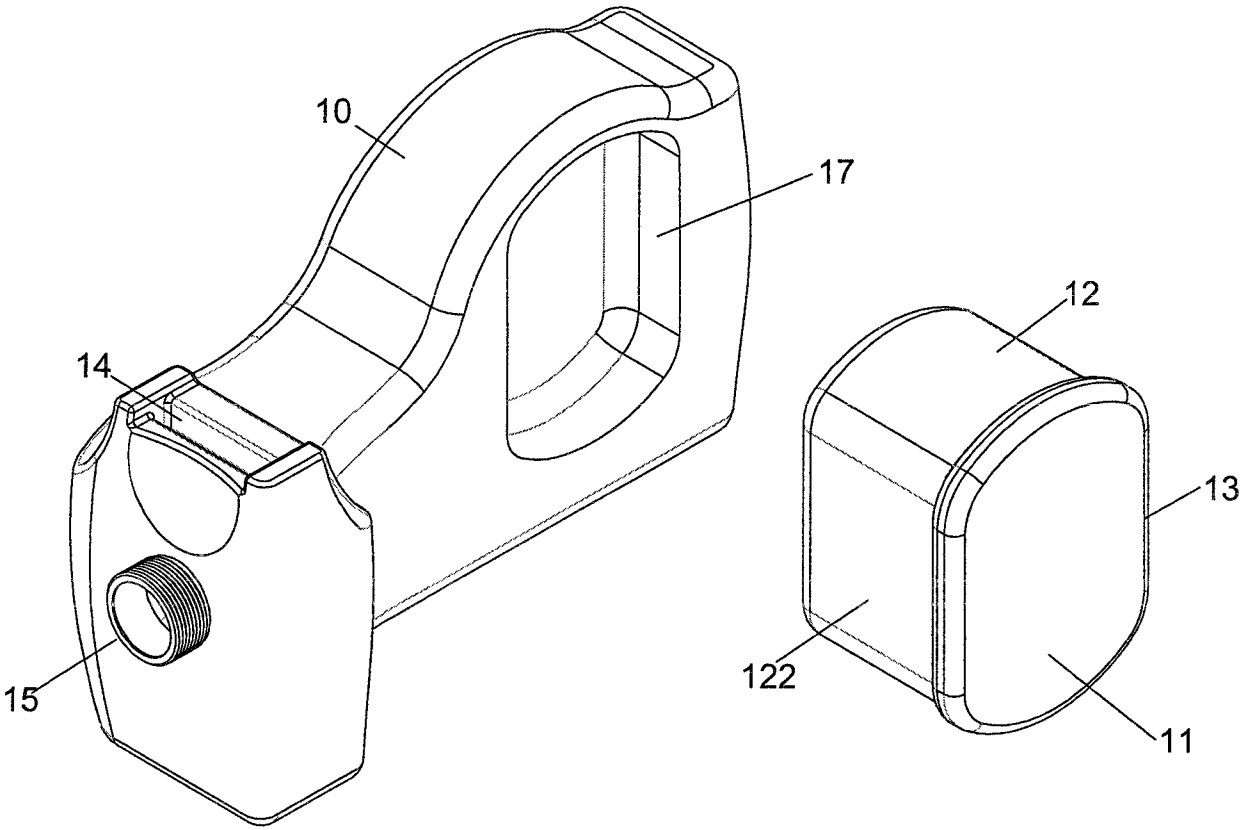
FIG. 12 is an exploded view to show the third embodiment of the tape dispenser of the present invention.

As shown in FIG. 12, in one embodiment, the frame 11 is a single part and the body 10 has a first connection portion 17 to which the frame 11 is securely connected. The opening 15 has a threaded portion defined in the outside thereof and a cover is threadedly connected to the threaded portion.

Figure 13:
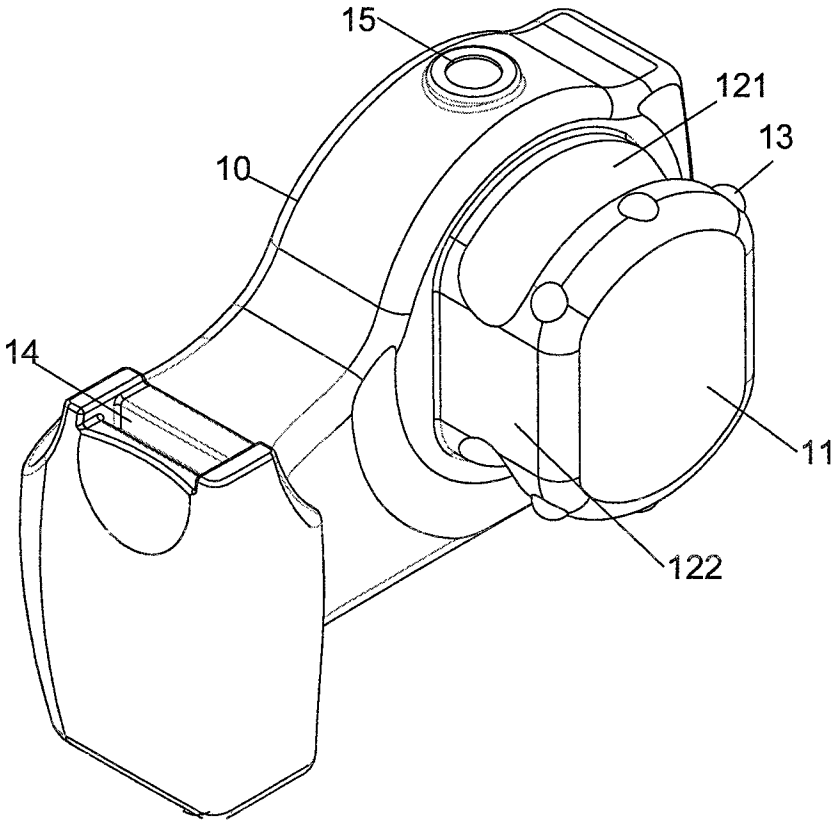
FIG. 13 is a perspective view to show the fourth embodiment of the tape dispenser of the present invention.

In one embodiment, as shown in FIG. 13, the restriction portion 13 has multiple bosses.

Figure 15:
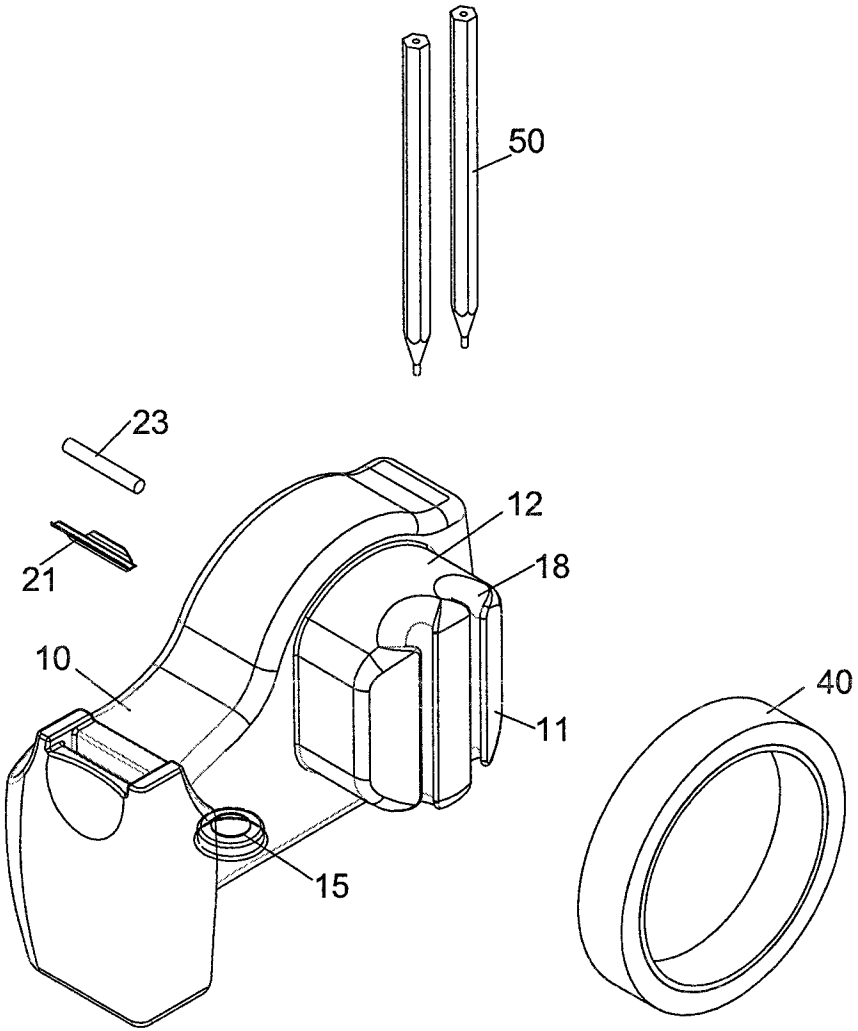
FIG. 15 is a side view to show the blade of the fifth embodiment of the tape dispenser of the present invention.
Figure 14:
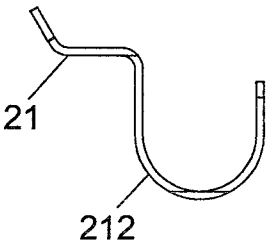
FIG. 14 is an exploded view to show the fifth embodiment of the tape dispenser of the present invention.

As shown in FIGS. 14 and 15, in one embodiment, the frame 11 has at least recessed accessories stand 18 defined in the rear end thereof and at least one restriction member 50 is located in the accessories stand 18. The at least one restriction member 50 can be a pen, scissors, a box cutter and other stationery. The at least one restriction member 50 plays a role as the restriction portion 13. The accessory stand 18 accommodates the tape 40. The opening 15 is located at the bottom of the body 10 and the blade 21 is a U-shaped blade and has a pressing portion 212 which is engaged with the blade seat 14.

Figure 17:
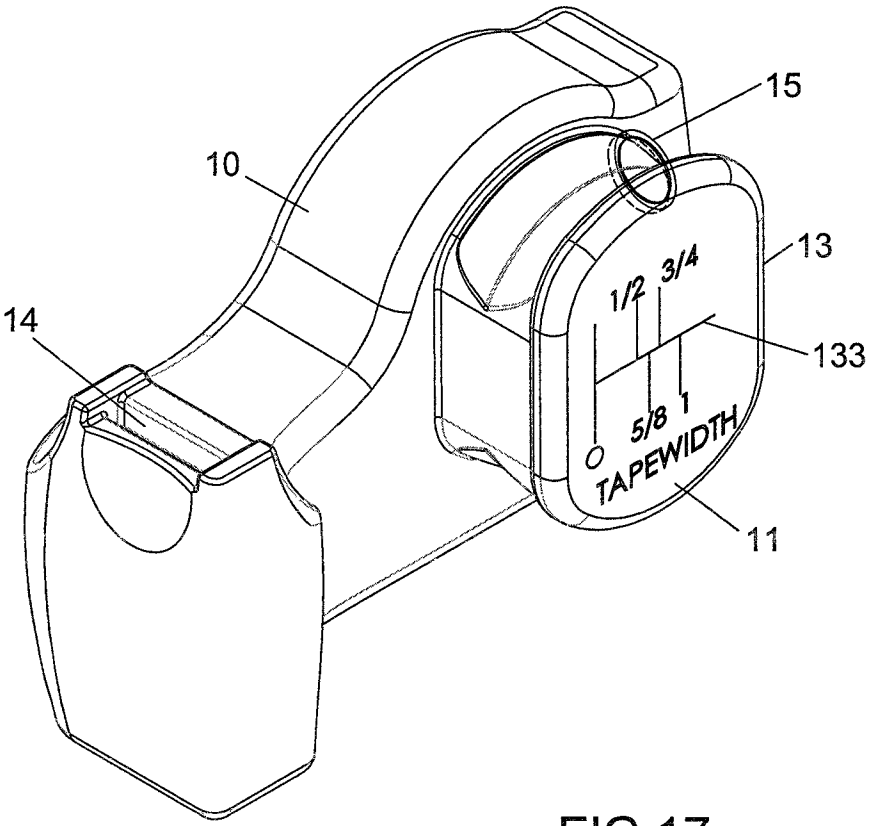
FIG. 17 is a side view to show the blade of the sixth embodiment of the tape dispenser of the present invention.
Figure 16:
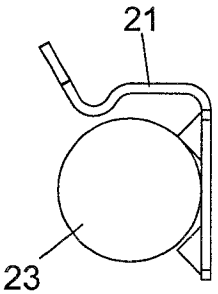
FIG. 16 is a perspective view to show the sixth embodiment of the tape dispenser of the present invention.

As shown in FIGS. 16 and 17, in one embodiment, the recess 121 is a V-shaped recess and the tape 40 is located at the middle portion of the reception portion 12. A width scale 133 is installed to the body 10 and located at the end face of the frame 11 to show width of the tape 40. The blade 21 is an L-shaped blade. The blade unit 20 has a pressing member 23 which is connected to the blade 21, and then connection is engaged with the blade seat 14.

Figure 18:
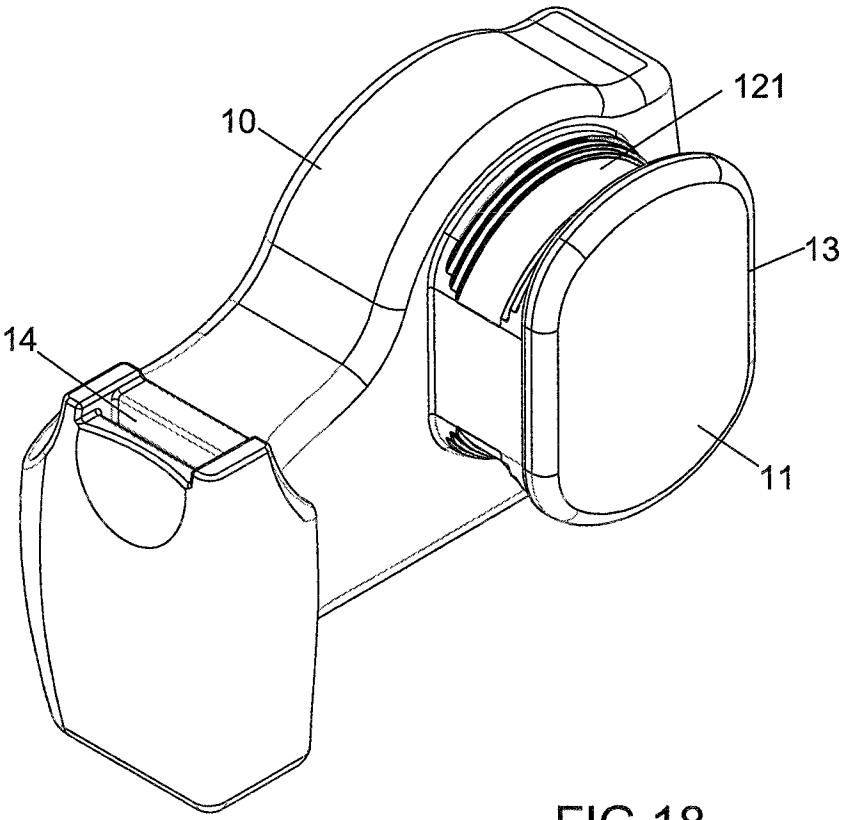
FIG. 18 is a perspective view to show the seventh embodiment of the tape dispenser of the present invention.

As shown in FIG. 18, in one embodiment, the recesses 121 are stepped recesses so as to accommodate the tapes 40 of different widths and the tape 40 is located corresponding to the blade unit 20.

Figure 19:
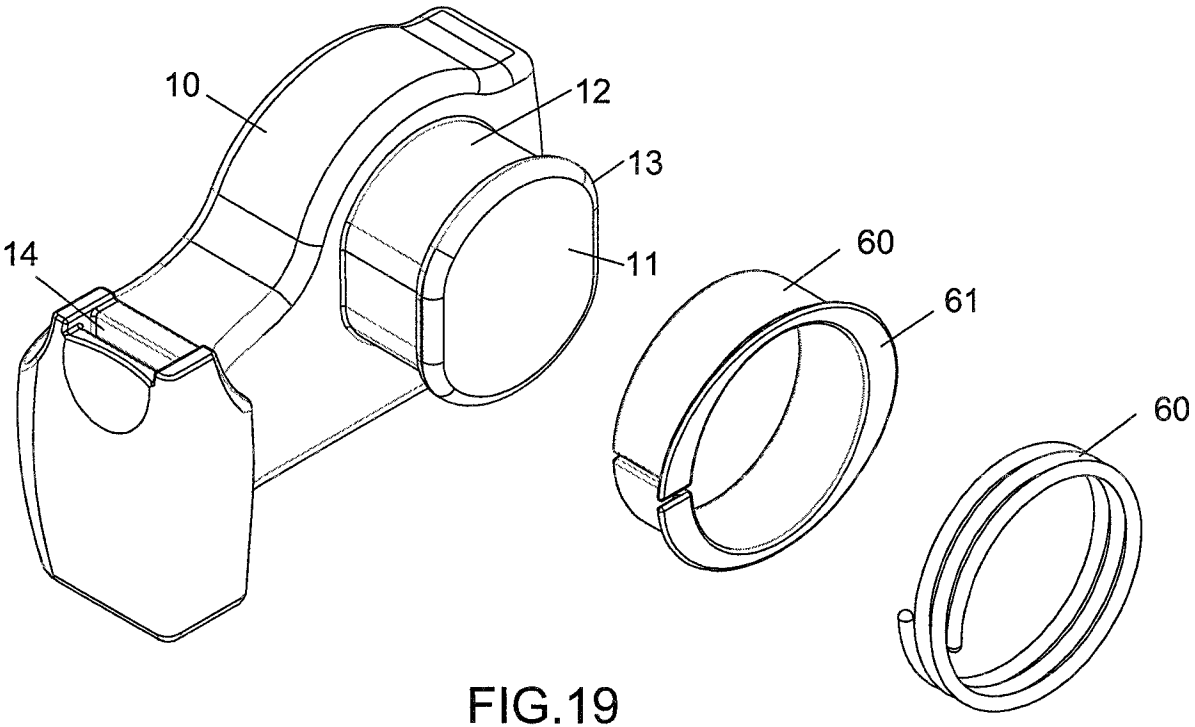
FIG. 19 is an exploded view to show the eighth embodiment of the tape dispenser of the present invention.

As shown in FIG. 19, in one embodiment, a collar 60 is mounted to the reception portion 12 and has a stop 61, the tape 40 is mounted to the collar 60 and restricted by the stop 61. The tape dispenser of the present invention can be used with the tapes of different inner diameters by the collar 60. The collar 60 is rotatable relative to the reception portion 12 and the tape 40 is co-rotated with the collar 60 when being pulled.

Figure 20:
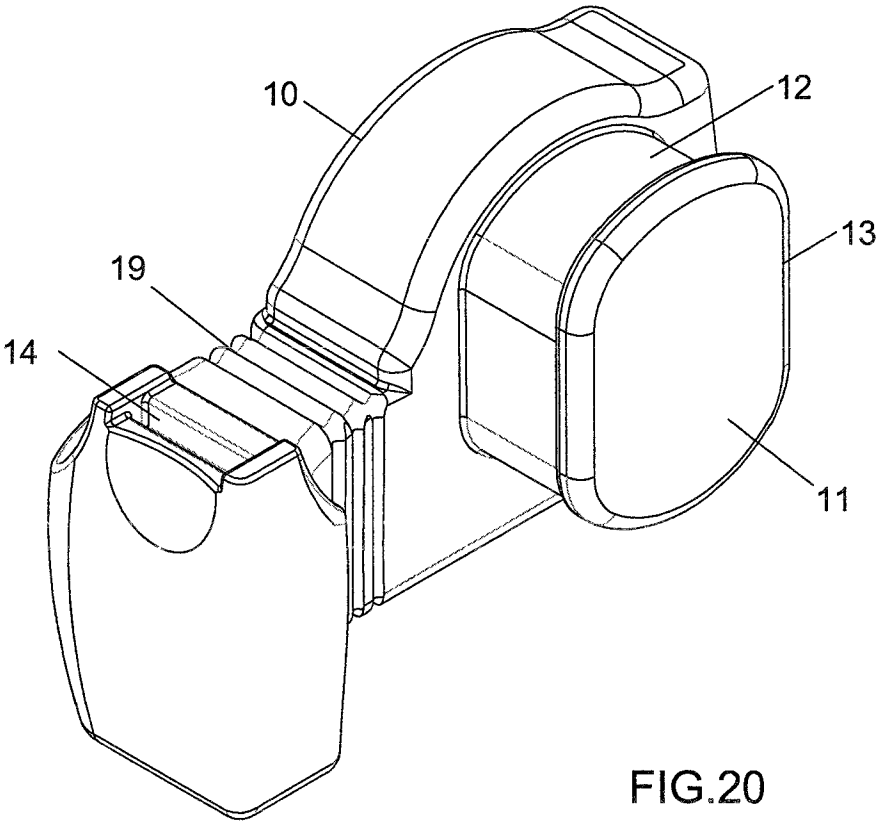
FIG. 20 is a perspective view to show the ninth embodiment of the tape dispenser of the present invention.

As shown in FIG. 20, in one embodiment, a bent portion 19 is located between the body 10 and the blade seat 14 so as to adjust length of the body 10 and the distance between the reception portion 12 and the blade seat 14.

Figure 21:
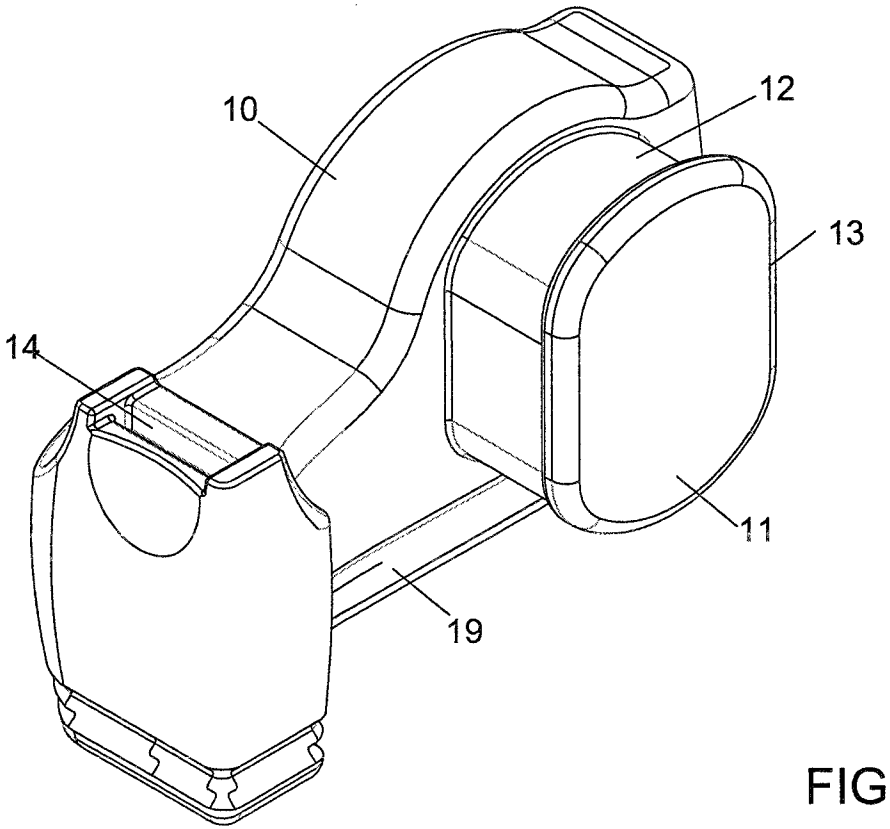
FIG. 21 is a perspective view to show the tenth embodiment of the tape dispenser of the present invention.

As shown in FIG. 21, in one embodiment, a bottom of the body 10 is located at the bent portion 19 so as to adjust length of the body 10 as needed. When the tape dispenser drops on the floor, the bent portion 19 buffers the impact. The bent portion 19 also provides an expandable space for the sands in the body 10. Alternatively, the reception portion 12 of the body 10 may have a bent portion 19 so that the reception portion 12 is extendable.

Figure 22:
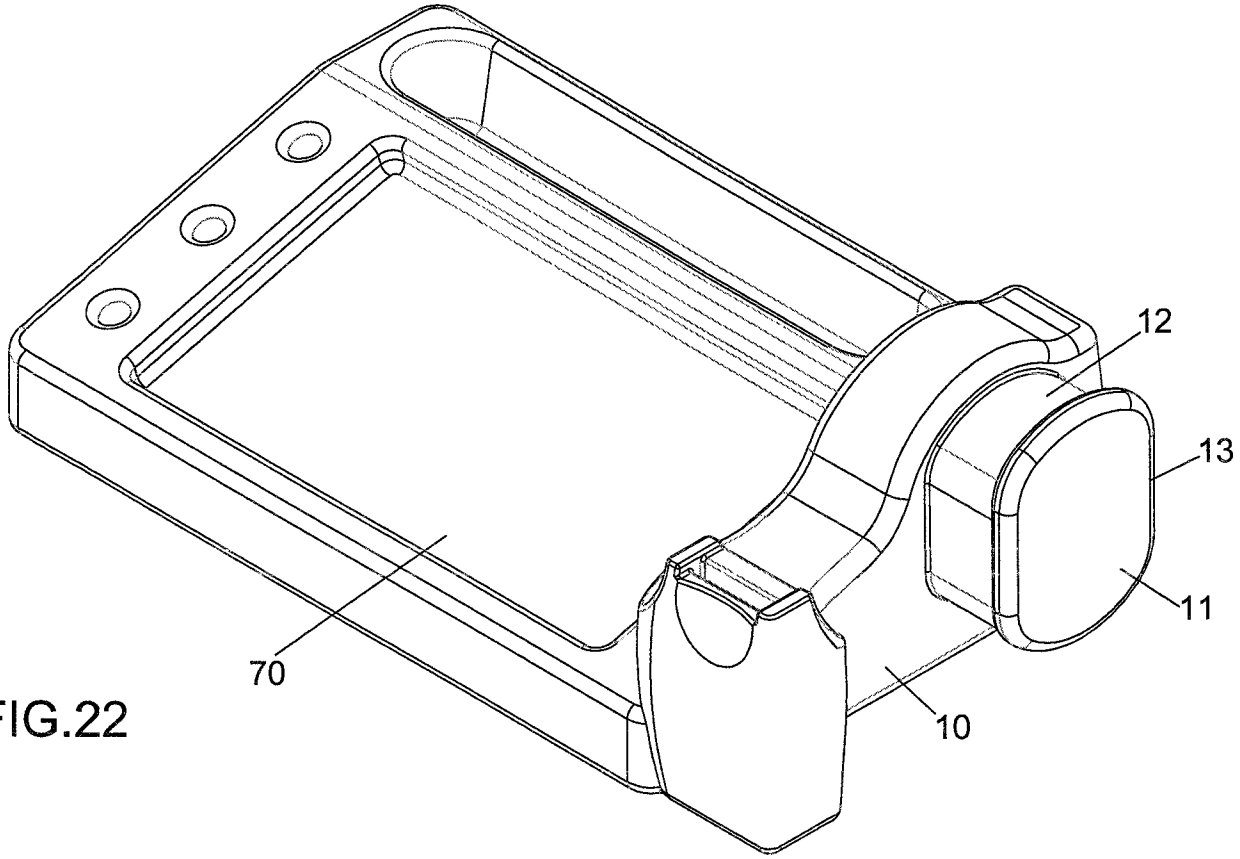
FIG. 22 is a perspective view to show the eleventh embodiment of the tape dispenser of the present invention.

As shown in FIG. 22, in one embodiment, the body 10 has an accessory stand 18 extending from one side thereof.

Figure 23:
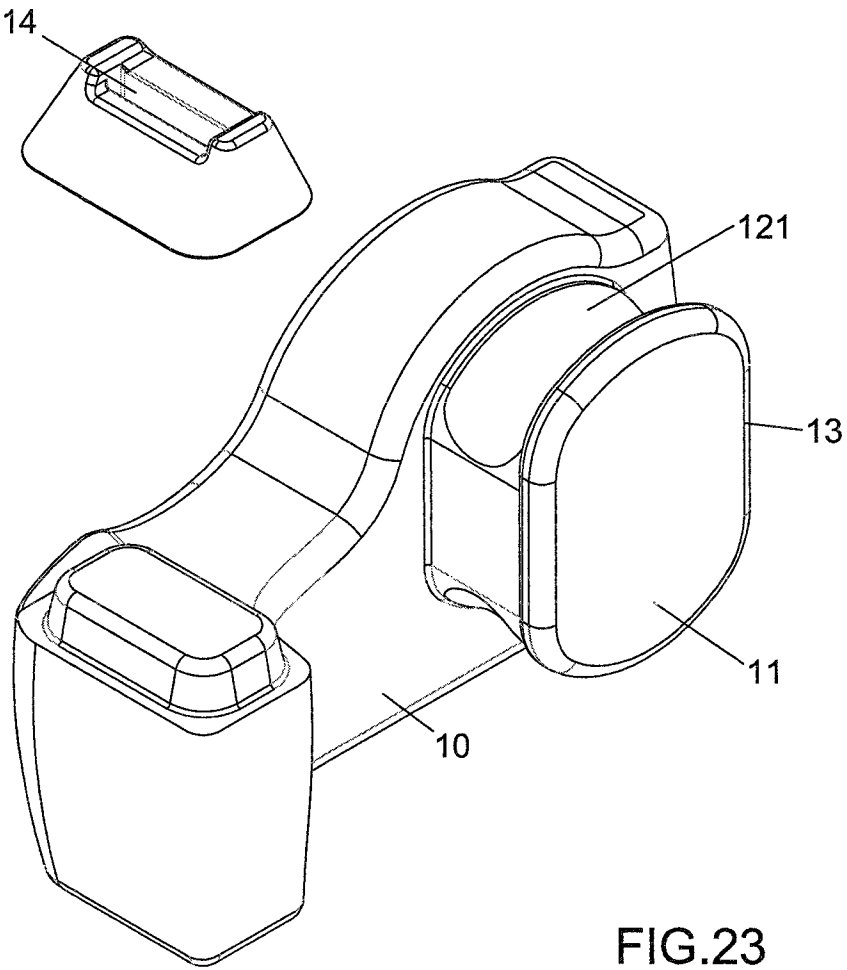
FIG. 23 is a perspective view to show the twelfth embodiment of the tape dispenser of the present invention.

As shown in FIG. 23, in one embodiment, the blade seat 14 is a single part which is removably connected to the body 10.

Figure 24:
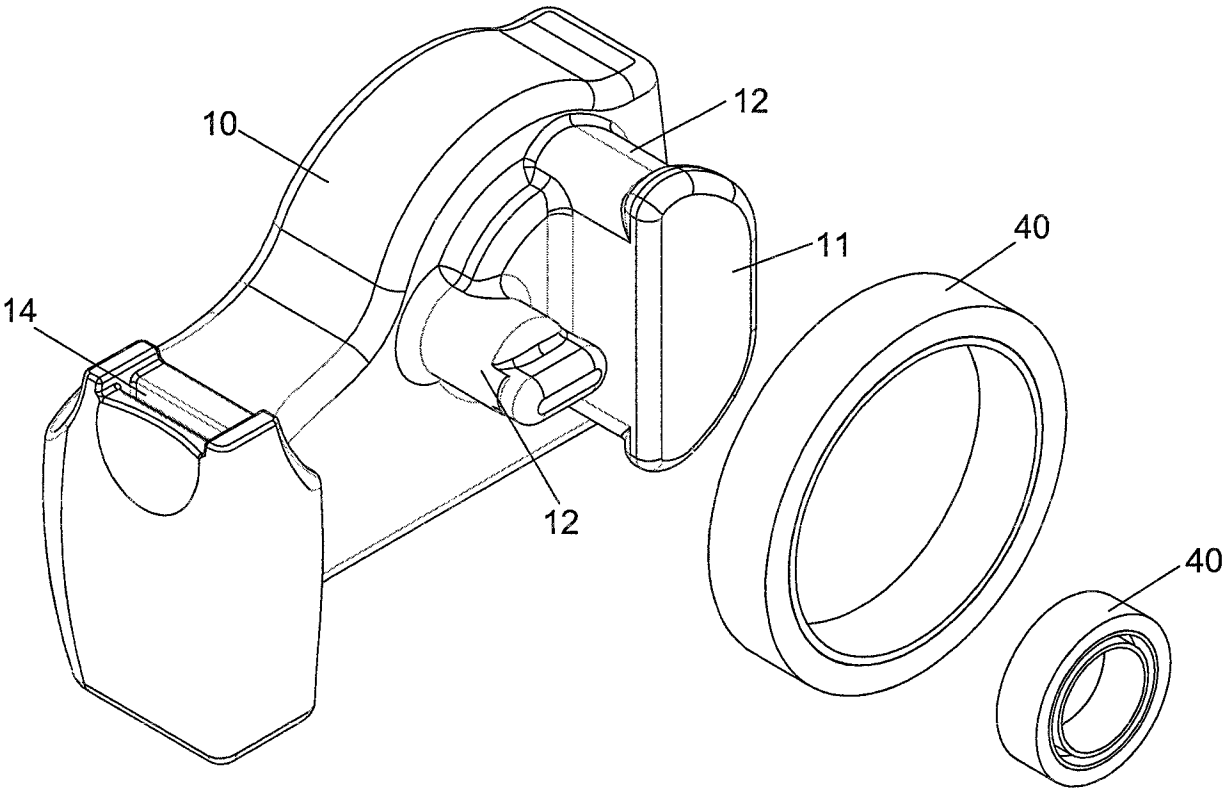
FIG. 24 is an exploded view to show the thirteenth embodiment of the tape dispenser of the present invention.
Figure 25:
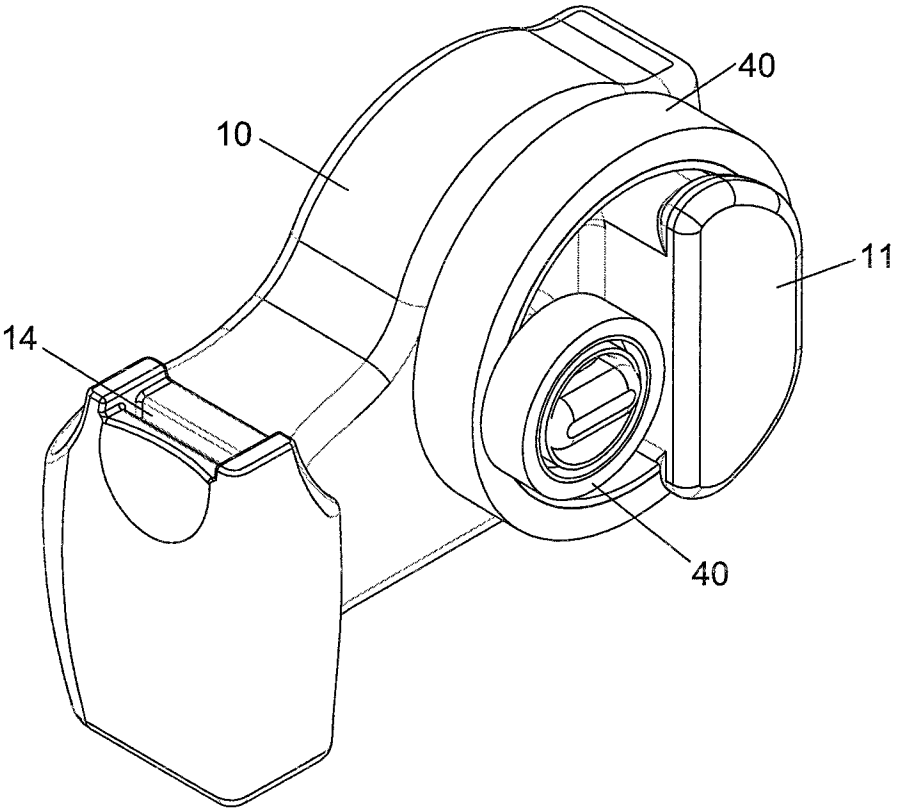
FIG. 25 is a perspective view to show the thirteenth embodiment of the tape dispenser of the present invention.

As shown in FIGS. 24 and 25, in one embodiment, there are two reception portions 12 so as to accommodate the tapes 40 of different inner diameters.

Figure 27:
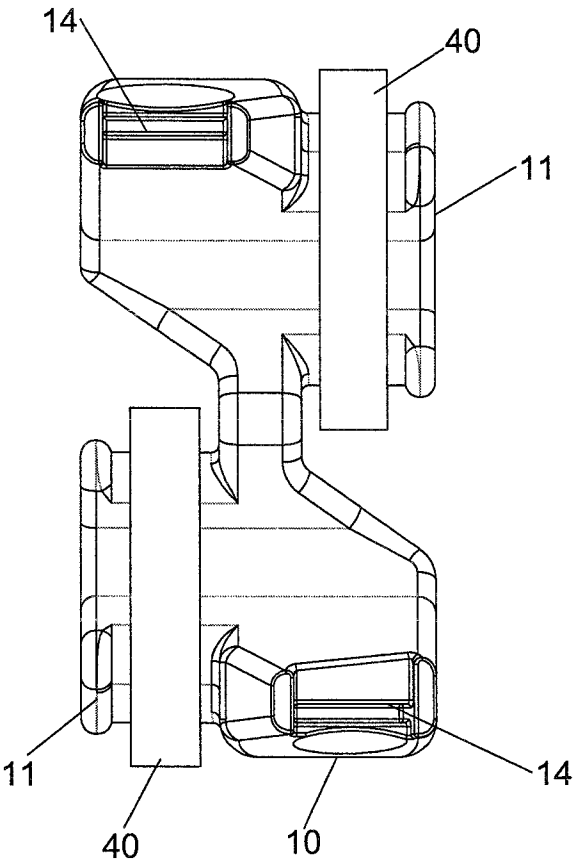
FIG. 27 is a top view of the fourteenth embodiment of the tape dispenser of the present invention.
Figure 26:
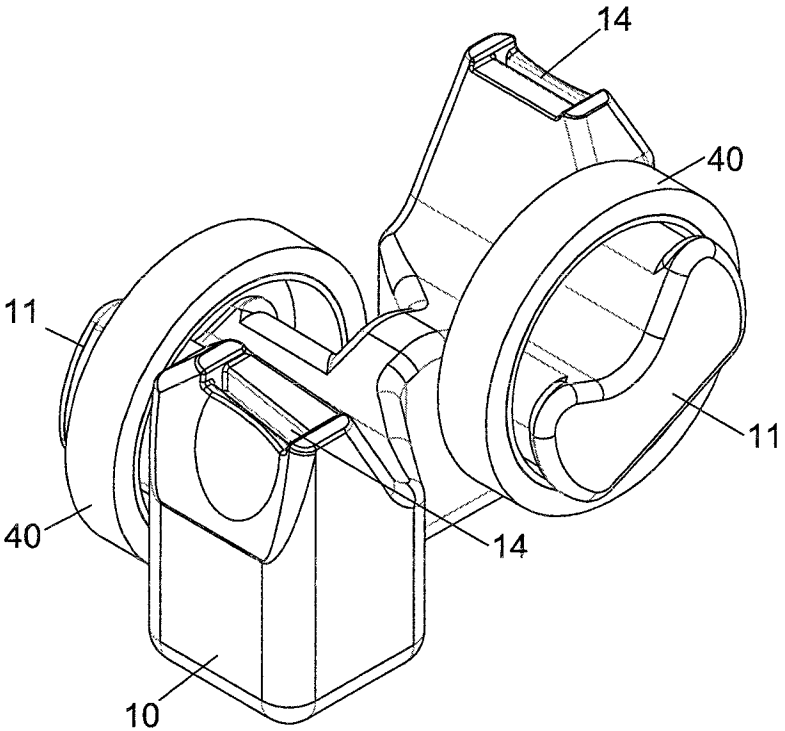
FIG. 26 is a perspective view to show the fourteenth embodiment of the tape dispenser of the present invention.

As shown in FIGS. 26 and 27, in one embodiment, the body 10 has the frame 11 and the blade seat 14 on two sides thereof, the frame 11 accommodates the tape 40. The blade seat 14 has an inclined portion and the blade unit 20 or the blade 21 is engaged with the blade seat 14. The blade 21 has an inclined portion relative to the tape 40.

Figure 28:
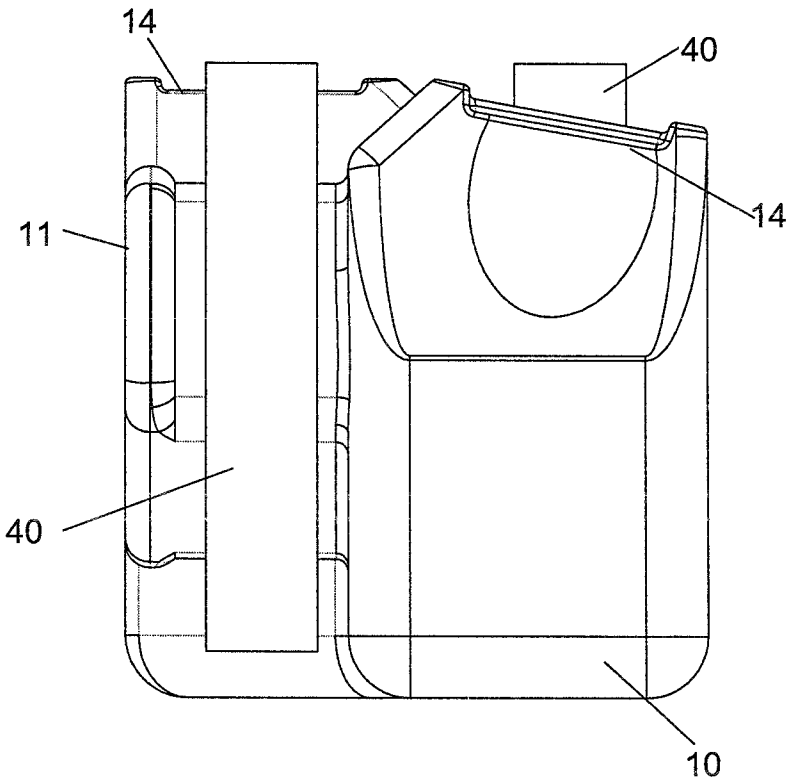
FIG. 28 is a front view of the fourteenth embodiment of the tape dispenser of the present invention.
Figure 29:
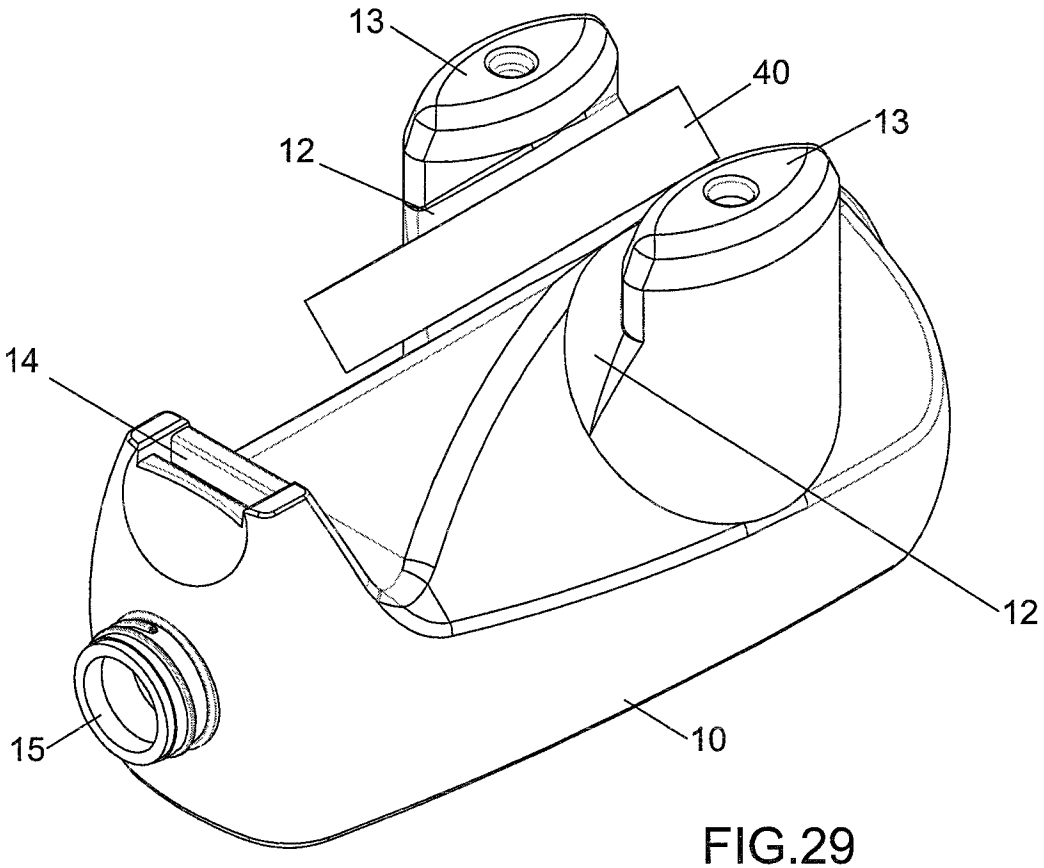
FIG. 29 is a perspective view to show the fifteenth embodiment of the tape dispenser of the present invention.

As shown in FIGS. 28 and 29, in one embodiment, there are two frames 11 located on two sides of the body 10 and extend inclinedly relative to the body 10.

Figure 30:
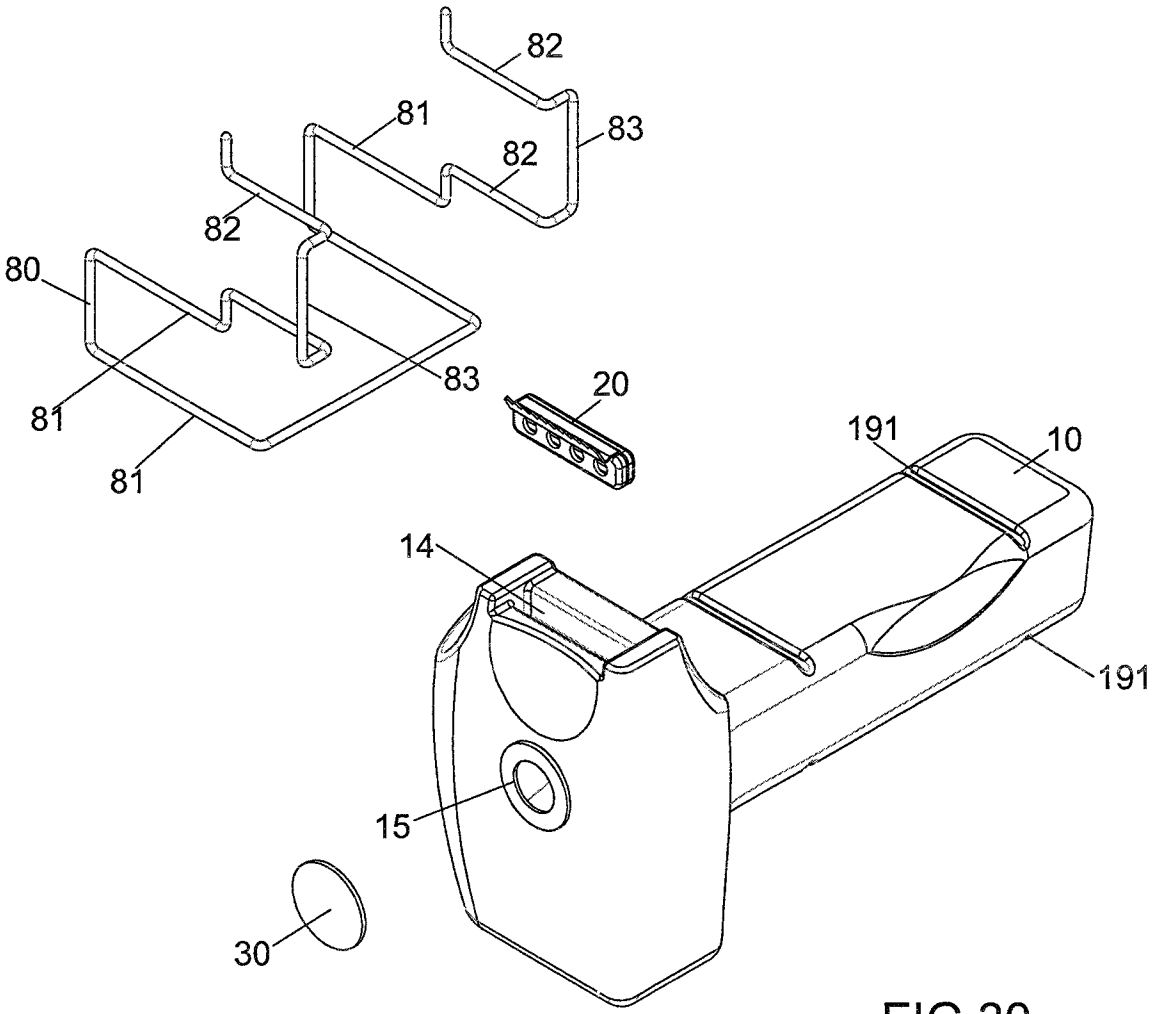
FIG. 30 is an exploded view to show the sixteenth embodiment of the tape dispenser of the present invention.

As shown in FIG. 30, in one embodiment, the body 10 has multiple slots 191 and the frame 11 is a linear frame and is bent to the frame 80 as shown which has multiple first engaging portions 81, reception portions 82 and restriction portion 83. The first engaging portions 81 are engaged with the slots 191, and the reception portions 82 accommodate the tape 40 which is restricted by the restriction portions 83.

Figure 31:
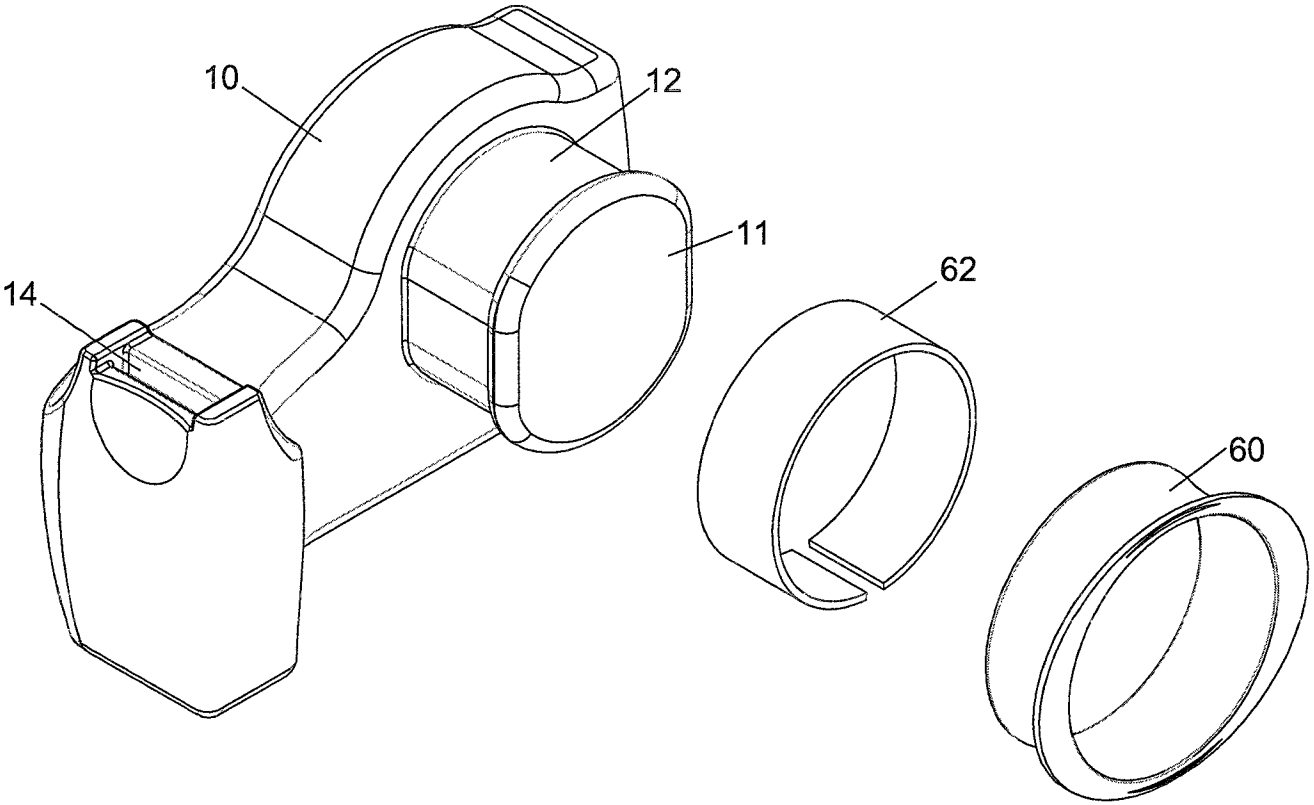
FIG. 31 is an exploded view to show the seventeenth embodiment of the tape dispenser of the present invention.

As shown in FIG. 31, in one embodiment, an elastic bushing 62 is located between the collar 60 and the reception portion 12, and the collar 60 is mounted to the reception portion 12 by the bushing 62.

Figure 32:
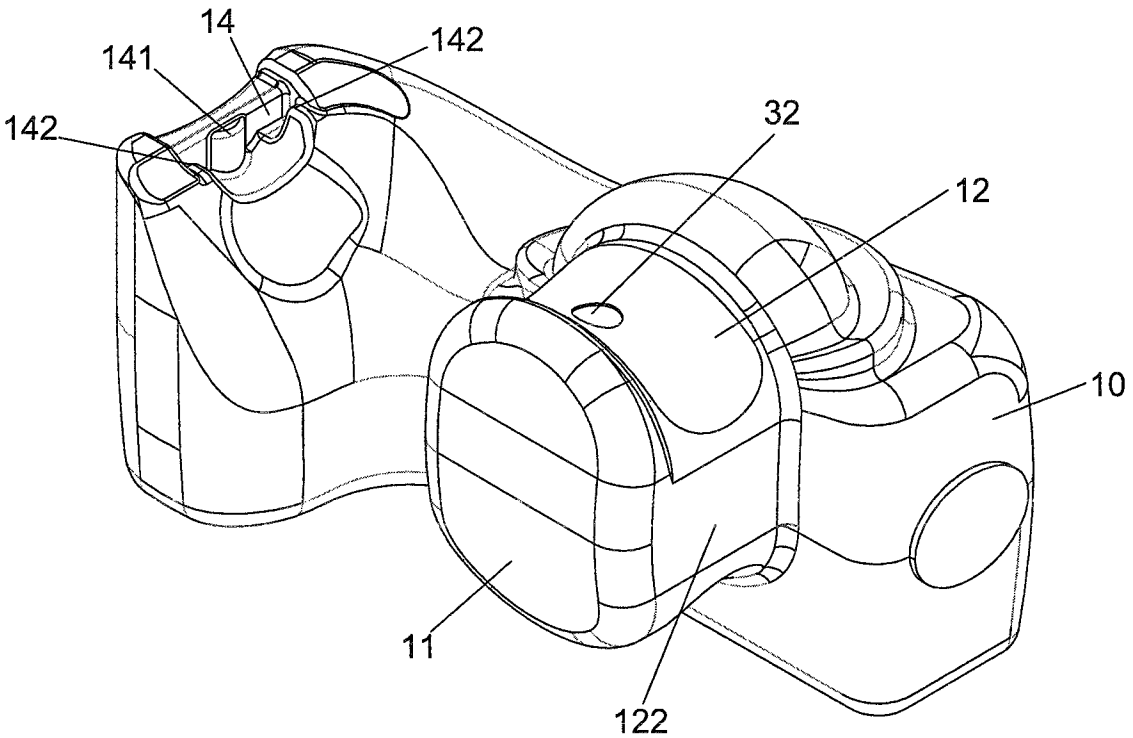
FIG. 32 is a perspective view to show the eighteenth embodiment of the tape dispenser of the present invention.

As shown in FIG. 32, in one embodiment, the blade seat 14 has a first extension 141 and a second extension 142 so as to be engaged with the blade 21.

Figure 33:
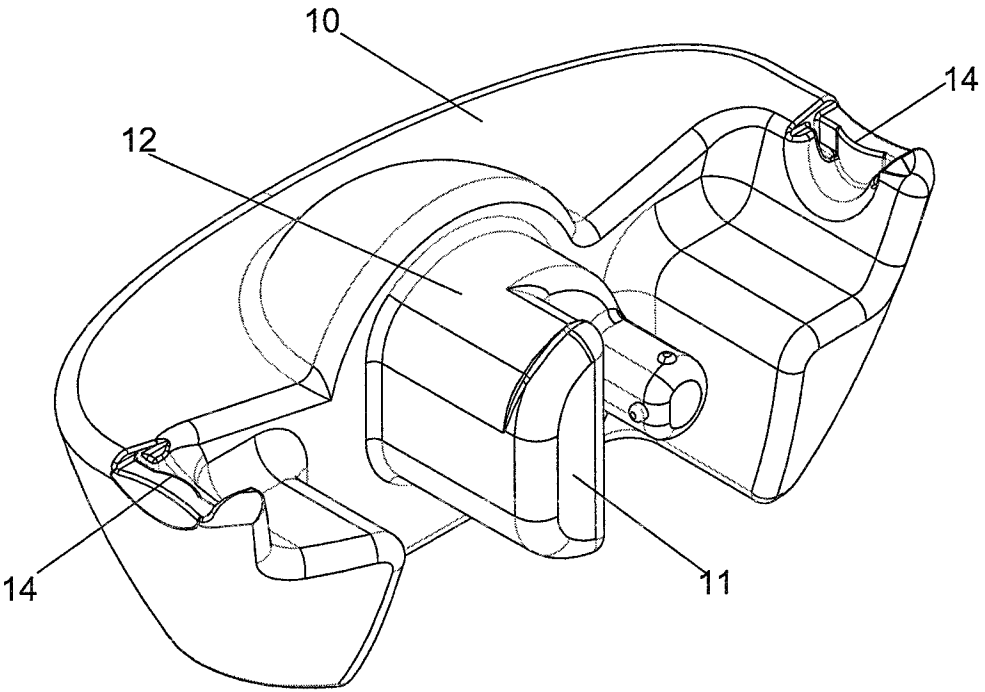
FIG. 33 is a perspective view to show the nineteenth embodiment of the tape dispenser of the present invention.

As shown in FIG. 33, in one embodiment, the body 10 has two blade seats 14 located at two ends thereof.

The body 10 is a hollow part and the frame 11 on one side of the body 10 is a single part so as to reduce the manufacturing cost. The body 10 has a thin crust which allows small tolerance when being molded, and patterns, logos, characters can be made on the surface of the body 10. The hollow body 10 has the opening 15 through which the sands, concrete or fluid can be easily filled in the body 10. The frame 11 is located on one side of the body 10 and the tape 40 is connected to the framell so that the replacement of the tape 40 is easy.

The parting line of the body 10 is located on the vertical portion 122 so that the top mold and the bottom mold is connected at the vertical portion 122, so that the bottom of the body 10 is required to be smaller than the vertical portion 122, the body 10 is easily removed from the molds.

While we have shown and described the embodiment in accordance with the present invention, it should be clear to those skilled in the art that further embodiments may be made without departing from the scope of the present invention.

What is claimed is:

1. A tape dispenser comprising:

a hollow body having a frame extending therefrom, a reception portion defined between the body and the frame, a tape located in the reception portion which has two recesses and two vertical portions, the two vertical portions facing a front end and a rear end of the body, the frame having a restriction portion on a rear end thereof, a first protrusion and a second protrusion respectively extending from a top end and a bottom end of the restriction portion, the first protrusion being higher than the second protrusion, a recessed blade seat defined in the front end of the body and located corresponding to the reception portion, the body having an opening which communicates with inside of the body, weight being located in the opening;

a blade unit located in the blade seat and having a blade and a blade carrier, the blade having a flange and being shaped as an inverted N, the blade carrier having two parts and each part having an edge with a recessed area defined therein, the two parts connected to each other to clamp the blade, the flange being engaged with the recessed areas, the blade carrier engaged with the blade seat, the recesses of the reception portion each having a curved face, and a seal member sealing the opening.

2. The dispenser as claimed in claim 1, wherein the weight is sands or concrete.

3. The dispenser as claimed in claim 1, wherein the body has a handle extending therefrom.

4. The dispenser as claimed in claim 1, wherein the frame is a single part and the body has a first connection portion to which the frame is securely connected.

5. The dispenser as claimed in claim 1, wherein the opening has a threaded portion defined in an outside thereof and a cover is threadedly connected to the threaded portion.

6. The dispenser as claimed in claim 1, wherein the restriction portion has multiple bosses.

7. The dispenser as claimed in claim 1, wherein the frame has at least recessed accessories stand defined in the rear end thereof and at least one restriction member is located in the accessories stand, the at least one restriction member is the restriction portion.

8. The dispenser as claimed in claim 1 further having a width scale to show width of the tape.

9. The dispenser as claimed in claim 1, wherein the recesses are stepped recesses so as to accommodate the tapes of different widths.

10. The dispenser as claimed in claim 1, wherein a collar is mounted to the reception portion and has a stop, the tape is mounted to the collar and restricted by the stop.

11. The dispenser as claimed in claim 1, wherein a bent portion is located between the body and the blade seat so as to adjust length of the body.

12. The dispenser as claimed in claim 11, wherein a bottom of the body is located at the bent portion.

13. The dispenser as claimed in claim 1, wherein the reception portion of the body has a bent portion so that the reception portion is extendable.

14. The dispenser as claimed in claim 1, wherein the body has an accessory stand extending from one side thereof.

15. The dispenser as claimed in claim 1, wherein the blade seat is a single part which is removably connected to the body.

16. The dispenser as claimed in claim 1, wherein there are two reception portions so as to accommodate the tapes of different inner diameters.

17. The dispenser as claimed in claim 1, wherein the body has the frame and the blade seat on two sides thereof, the frame accommodates the tape.

18. The dispenser as claimed in claim 1 further comprising an elastic bushing which is located between the collar and the reception portion.

19. The dispenser as claimed in claim 1, wherein the blade seat has a first extension and a second extension so as to be engaged with the blade.

20. The dispenser as claimed in claim 1, wherein the body has two blade seats located at two ends thereof.

* * * * *